US010256087B2

(12) United States Patent
Baba

(10) Patent No.: US 10,256,087 B2
(45) Date of Patent: Apr. 9, 2019

(54) BAND PASS EXTRACTION FROM AN ION TRAPPING DEVICE AND TOF MASS SPECTROMETER SENSITIVITY ENHANCEMENT

(71) Applicant: DH Technologies Development PTE Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/329,376

(22) PCT Filed: Jul. 24, 2015

(86) PCT No.: PCT/IB2015/055625

§ 371 (c)(1),
(2) Date: Jan. 26, 2017

(87) PCT Pub. No.: WO2016/020789

PCT Pub. Date: Feb. 11, 2016

(65) Prior Publication Data

US 2017/0221692 A1 Aug. 3, 2017

Related U.S. Application Data

(60) Provisional application No. 62/033,380, filed on Aug. 5, 2014.

(51) Int. Cl.
*H01J 49/00* (2006.01)
*H01J 49/40* (2006.01)
(Continued)

(52) U.S. Cl.
CPC ..... *H01J 49/403* (2013.01); *H01J 49/063* (2013.01); *H01J 49/067* (2013.01); *H01J 49/429* (2013.01)

(58) Field of Classification Search
CPC ..... H01J 49/403; H01J 49/067; H01J 49/063
(Continued)

(56) References Cited

U.S. PATENT DOCUMENTS 5,861,623 A * 1/1999 Park ..... H01J 49/403 250/282
6,075,244 A * 6/2000 Baba ..... H01J 49/423 250/281

(Continued)

FOREIGN PATENT DOCUMENTS

WO 2013098600 A1 7/2013

OTHER PUBLICATIONS

International Search Report and Written Opinion for PCT/IB2015/055625 dated Nov. 16, 2015.

*Primary Examiner* — Michael Maskell

(57) ABSTRACT

A multipole rod set of an ion guide is adapted to receive a radial RF trapping voltage and a radial dipole direct current DC voltage. A lens electrode of the ion guide is positioned at one end of the multipole rod set to extract ions from the multipole rod set and adapted to receive an axial trapping AC voltage and a DC voltage. A radial dipole DC voltage is applied to the multipole rod set and an axial trapping AC voltage is simultaneously applied to a lens electrode in order to extract a bandpass mass range of ions trapped in the multipole rod set. Alternatively, a radial RF trapping voltage amplitude is applied to the multipole rod set and an axial trapping AC voltage is simultaneously applied to the lens electrode in order to extract a bandpass mass range of ions trapped in the multipole rod set.

11 Claims, 8 Drawing Sheets

(51) Int. Cl.
*H01J 49/42* (2006.01)
*H01J 49/06* (2006.01)

(58) Field of Classification Search
USPC ..... 250/281, 282, 290, 292, 293
See application file for complete search history.

(56) References Cited

U.S. PATENT DOCUMENTS

| | | | | |
|---|---|---|---|---|
| 6,987,264 | B1 * | 1/2006 | Whitehouse | H01J 49/004 250/292 |
| 7,060,987 | B2 * | 6/2006 | Lee | H01J 49/147 134/1 |
| 7,189,967 | B1 * | 3/2007 | Whitehouse | H01J 49/063 250/292 |
| 2006/0169884 | A1 * | 8/2006 | Syka | H01J 49/0095 250/282 |
| 2010/0123073 | A1 | 5/2010 | Guest et al. | |
| 2010/0314537 | A1 * | 12/2010 | McLuckey | H01J 49/063 250/282 |
| 2013/0009051 | A1 | 1/2013 | Park | |
| 2013/0112865 | A1 | 5/2013 | Green et al. | |

* cited by examiner

100

300

400

500

BAND PASS EXTRACTION FROM AN ION TRAPPING DEVICE AND TOF MASS SPECTROMETER SENSITIVITY ENHANCEMENT

CROSS REFERENCE TO RELATED APPLICATION

This application claims the benefit of U.S. Provisional Patent Application Ser. No. 62/033,380, filed Aug. 5, 2014, the content of which is incorporated by reference herein in its entirety.

INTRODUCTION

Various embodiments relate generally to mass spectrometry, and more particularly to systems and methods for extracting ions from ion guides in order to enhance the sensitivity of time-of-flight (TOF) mass spectrometry analysis.

Many types of mass spectrometers are known, and are widely used for trace analysis and for determining the structure of ions. These spectrometers usually separate ions based on their mass-to-charge ratio (m/z). Some of these spectrometers include quadrupole mass filters, in which RF/DC ion guides are used for transmitting ions within a narrow range of m/z values; magnetic sector analyzers, in which large magnetic fields exert forces perpendicular to the direction of motion of moving ions, in order to deflect the ions according to their m/z; and time-of-flight (TOF) analyzers, in which measurement of flight time over a known path for an ion allows the determination of its m/z.

Unlike quadrupole mass filters, TOF analyzers can record complete mass spectra without the need for scanning parameters of a mass filter, thus providing a higher duty cycle and resulting in better use of the sample. In certain mass spectrometers, RF ion guides are coupled with orthogonal TOF mass analyzers, where the ion guide is for the purpose of transmitting ions to the TOF analyzer, or are used as collision cells for producing product ions and for delivering the product ions (in addition to any remaining precursor ions) to the TOF analyzer. Combining an ion guide with the orthogonal TOF is a convenient way of delivering ions to the TOF analyzer for analysis.

It is presently known to employ at least three modes of operation of orthogonal TOF mass spectrometers employing ion guides. In the first mode, a continuous stream of ions leaves a radio-frequency (RF) quadrupole ion guide and is directed to an extraction region of the TOF analyzer. A part of the stream is then sampled by TOF acceleration pulses for detection in the normal TOF manner. This mode of operation has duty cycle losses.

The second mode of operation involves pulsing ions out of an ion guide such that ions having non-particular m/z values are bunched together in the acceleration region of the TOF. This mode of operation reduces transmission losses between the ion guide and the TOF, but due to the dependence of ion velocity on the m/z ratio only ions from a small m/z range can be properly synchronized, leading to a narrow range of m/z that can be effectively detected by the TOF analyzer. Thus, when ions with a broad range of masses have to be recorded, it is necessary to transmit multiple pulses having parameters specific to overlapping m/z ranges in order to record a full spectrum. This results in inefficiencies since ions outside the transmission window are either suppressed or lost.

The third mode of operation involves mass selective extraction out of an ion trap such that ions having particular m/z values (i.e., m/z values within narrowly-defined ranges) are bunched in the acceleration region of the TOF, and the timing of acceleration is synchronized to the ions with the particular m/z. The trapped ions out of the particular m/z values are held in the ion trap. This mode of operation reduces transmission losses between the ion trap and the TOF. When ions with a broad range of masses have to be recorded, it is necessary to transmit multiple pulses having parameters specific to overlapping m/z ranges in order to record a full spectrum. Because the ions out of the particular mass range are trapped to be analyzed in the followed extraction, this results in high efficiency.

Upstream of the TOF analyzer, ion fragmentation was traditionally performed in an ion guide using collision induced dissociation (CID). CID can have a number of shortcomings, however, specifically as relating to protein analysis or proteomics. For example, in proteomics, it is difficult to study posttranslational modifications, such as glycosylation and phosphorylation, using conventional CID methods because posttranslational moieties can be lost from the protein backbone in collisional fragmentation of the protein ions.

Electron capture dissociation ("ECD") and electron transfer dissociation ("ETD"), herein collectively referred to as "ExD" methods, have demonstrated very useful capabilities for protein analysis or proteomics. However, ExD methods suffer from efficiency problems, e.g., caused by remaining precursor ions after the reaction. These efficiency problems, in turn, negatively affect the sensitivity of TOF analysis.

A number of methods have been proposed for trapping and mass selectively extracting ions from an ion trap in order to enhance the sensitivity of TOF analysis. For example, U.S. Pat. Nos. 5,783,824 and 7,329,862 are directed to mass selective axial resonant extraction (AREX). In AREX, ions are mass selectively extracted from a linear ion trap by an AC field for resonant excitation. The extracted ions are bunched near an exit lens electrode by the resonant excitation and then injected into a TOF mass spectrometer. Because of the resonant AC excitation, however, AREX requires an additional cooling device. The cooling device is needed to decrease the spatial distribution and the m/z distribution. The resonant AC excitation can also cause an unwanted secondary dissociation.

Another method that has been proposed to enhance the sensitivity of TOF analysis without AC excitation is Zeno pulsing. For example, U.S. Pat. Nos. 6,852,972 and 7,456,388 are directed to methods of Zeno pulsing. In Zeno pulsing a radio frequency amplitude applied to an extraction lens is quickly scanned linearly for a mass selective extraction. The extracted ions with different m/z values are then spatially focused on the accelerator of the TOF spectrometer. However, because the mass selective extraction used in Zeno pulsing is a high m/z pass filter, a continuous ion injection scheme loses many of the high m/z ions. Additionally, the duty cycle may be less than 100% due to the required trapping and cooling operation.

Another method that can be used to enhance the sensitivity of TOF analysis is AC excitation low pass filtering. For example, U.S. patent application Ser. No. 14/367,261 describes a method for trapping ions that includes providing at least first and second multipole rod sets positioned in tandem. An RF potential is applied to at least one of the rod sets to generate a radial trapping potential within the rod sets, a radial direct current (DC) dipolar potential is applied to the first rod set so as to modulate the radial trapping potential set as a function of m/z of said ions, and a DC potential is applied between the two rod sets to provide an axial bias potential between said two rod sets.

The method further includes selecting an axial barrier potential to selectively extract ions having an m/z ratio less than a threshold from the first rod set into the second rod set. The axial barrier potential can be changed for mass selective low pass operation by changing the radial DC potential or by changing the radial RF potential to create a high pass filter, or sequentially using the radial DC potential and the radial RF potential. Low m/z extraction without AC excitation and high m/z extraction without AC extraction have been separately disclosed, but no method to extract ions in particular m/z band, i.e., a band pass extraction method, has yet been disclosed.

Therefore it is desirable to have improved methods and systems for ion extraction, e.g., for band pass extraction of ions from an ion trap without AC excitation.

SUMMARY

A system is disclosed for mass selectively extracting ions. The system includes a multipole rod set of an ion guide, a lens electrode of the ion guide, and a processor in communication with the multipole rod set and the lens electrode.

The multipole rod set of an ion guide is adapted to receive a radial radio frequency (RF) trapping voltage and a radial dipole direct current (DC) voltage. The lens electrode of the ion guide is positioned at one end of the multipole rod set to extract ions trapped by the multipole rod set. The lens electrode of the ion guide is also adapted to receive an axial trapping alternating current (AC) voltage and a DC voltage.

The processor simultaneously applies a radial dipole DC voltage to the multipole rod set and an axial trapping AC voltage to the lens electrode or simultaneously applies a radial RF trapping voltage amplitude to the multipole rod set and an axial trapping AC voltage to the lens electrode in order to extract a bandpass mass range of ions trapped in the multipole rod set.

A method is disclosed for mass selectively extracting ions. A DC voltage to a multipole rod set of an ion guide and an axial trapping AC voltage to a lens electrode of the ion guide are simultaneously applied, or a radial RF trapping voltage amplitude to the multipole rod set and an axial trapping AC voltage to the lens electrode are simultaneously applied using a processor in order to extract a bandpass mass range of ions trapped in the multipole rod set.

The multipole rod set is adapted to receive the radial RF trapping voltage and the radial dipole voltage DC. The lens electrode is positioned at one end of the multipole rod set to extract ions trapped by the multipole rod set and adapted to receive the axial trapping AC voltage and a DC voltage.

A computer program product is disclosed that includes a non-transitory and tangible computer-readable storage medium whose contents include a program with instructions being executed on a processor so as to perform a method for mass selectively extracting ions. The method includes providing a system, wherein the system comprises one or more distinct software modules, and wherein the distinct software modules comprise a control module.

The control module simultaneously applies a radial dipole DC voltage to a multipole rod set of an ion guide and an axial trapping AC voltage to a lens electrode of the ion guide, or simultaneously applies a radial RF trapping voltage amplitude to the multipole rod set and an axial trapping AC voltage to the lens electrode in order to extract a bandpass mass range of ions trapped in the multipole rod set.

The multipole rod set is adapted to receive the radial RF trapping voltage and the radial dipole DC voltage. The lens electrode is positioned at one end of the multipole rod set to extract ions trapped by the multipole rod set and adapted to receive the axial trapping AC voltage and a DC voltage.

BRIEF DESCRIPTION OF THE DRAWINGS

The skilled artisan will understand that the drawings, described below, are for illustration purposes only. The drawings are not intended to limit the scope of the present teachings in any way.

Figure 1:
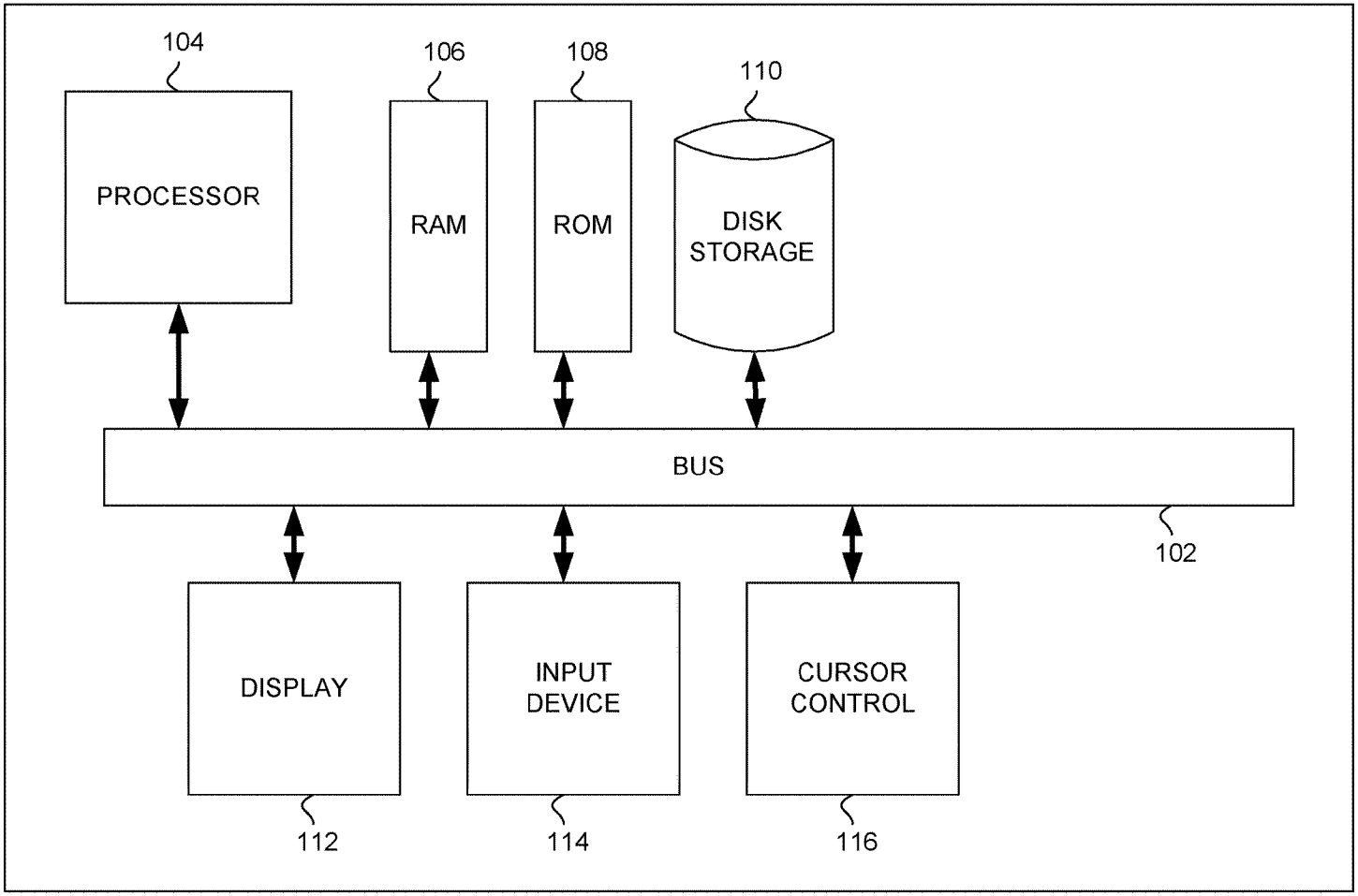
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Ion Extract from an Ion Guide

Embodiments of systems and methods for mass selectively extracting ions are described in this detailed description of the invention. In this detailed description, for purposes of explanation, numerous specific details are set forth to provide a thorough understanding of embodiments of the present invention. One skilled in the art will appreciate, however, that embodiments of the present invention may be practiced without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of embodiments of the present invention.

In various embodiments, the sensitivity of orthogonal time-of-flight (TOF) mass spectrometry analysis is enhanced by using a wide band pass filter to extract ions trapped in an ion guide. The wide band pass filter is produced by simultaneously and judiciously selecting voltages applied to a multipole rod set and exit lens electrode of the ion guide.

Using voltages applied to the multipole rod set and the exit lens electrode allows continuous band pass filter with no ion loss during filtering. Out of band ions remain trapped in the ion guide. Also, no resonant alternating current (AC) excitation is applied during the extraction and trapping period, thus avoiding collisional dissociation and the need for additional cooling.

System for Mass Selectively Extracting Ions

Figure 2:
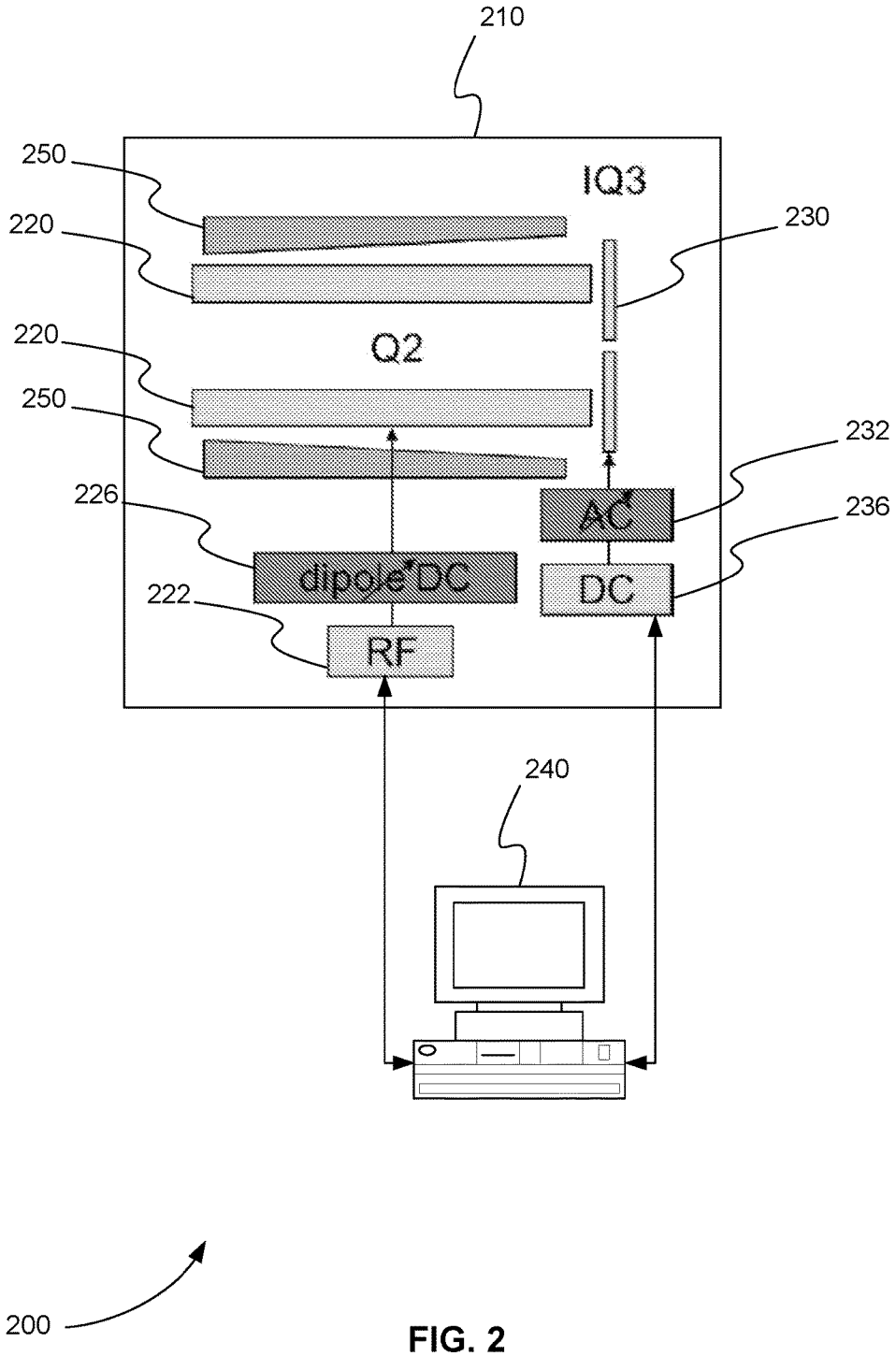
FIG. 2 is a schematic diagram of a system for mass selectively extracting ions, in accordance with various embodiments.

FIG. 2 is a schematic diagram of a system 200 for mass selectively extracting ions, in accordance with various embodiments. System 200 includes a multipole rod set 220 of ion guide 210, lens electrode 230 of ion guide 210, and processor 240.

Although FIG. 2 shows only two rods of multipole rod set 220, one of ordinary skill in the art can appreciate that multipole rod set 220 can have a variety of different configurations. Some examples of suitable rod sets comprise, without limitation, a quadrupole, a hexapole, an octapole, and so on. In the following, systems and methods according to various embodiments of the present teachings are described in which quadrupole rod sets are employed. It should, however, be understood that the present teachings are not limited to the use of quadrupole rod sets. Further, in some embodiments, one rod set can be one type of a multipole rod set (e.g., quadrupole) and the other rod set can be a different type of a multipole rod set (e.g., hexapole).

Also in the following, systems and methods according to various embodiments of the present teachings are described in which lens electrode 230 is referred to as electrode IQ3. It should, however, be understood that the present teachings are not limited to the use of electrode IQ3.

Processor 240 can be, but is not limited to, a computer, microprocessor, the computer system of FIG. 1, or any device capable of sending and receiving control information, processing data, and sending and receiving data. Processor 240 is in communication with multipole rod set 220 and lens electrode 230.

Multipole rod set 220 of ion guide 210 is adapted to receive a radial radio frequency (RF) trapping voltage through circuitry 222 and a radial dipole direct current (DC) voltage through circuitry 226. Lens electrode 230 is positioned at one end of multipole rod set to extract ions trapped by multipole rod set 220. Lens electrode 230 is adapted to receive an axial trapping alternating AC voltage through circuitry 232 and a DC voltage through 236. In other words, both multipole rod set 220 and lens electrode 230 have circuitry that allows either an AC voltage or DC to be applied via control signals. Although circuitry 222, 226, 232 and 236 are shown as part of ion guide 210 in FIG. 2, this circuitry can also be located outside of ion guide 210 or as part of processor 240, for example.

Processor 240 applies a radial dipole DC voltage to multipole rod set 220 using circuitry 226 and an axial trapping AC voltage to lens electrode 230 using circuitry 232 in order to extract a bandpass mass range of ions trapped in multipole rod set 220. Processor 240 holds the radial RF trapping voltage amplitude of multipole rod set 220 fixed using circuitry 222 and holds the DC voltage of lens electrode 230 fixed using circuitry 236. Alternatively, processor 240 simultaneously applies a radial RF trapping voltage amplitude to multipole rod set 220 using circuitry 222 and an axial trapping AC voltage to the lens electrode using circuitry 232 in order to extract a bandpass mass range of ions trapped in multipole rod set 220. Processor 240 holds the radial dipole DC voltage of multipole rod set 220 fixed using circuitry 226 and holds the DC voltage of lens electrode 230 fixed using circuitry 236.

Processor 240 applies a DC voltage on lens electrode 230 that is less than the radial dipole DC voltage that processor 240 applies to multipole rod set 220, when multipole rod set 220 is used to trap positive ions. Conversely, processor 240 applies a DC voltage on lens electrode 230 that is greater than the radial dipole DC voltage that processor 240 applies to the multipole rod set 220, when the multipole rod set is used to trap negative ions.

In various embodiments, system 200 further includes a linear accelerator (LINAC) 250 positioned coaxially with multipole rod set 220. LINAC 250 is used to further accelerate ions trapped in multipole rod set 220 and to further accumulate ions near lens electrode 230.

Figure 3:
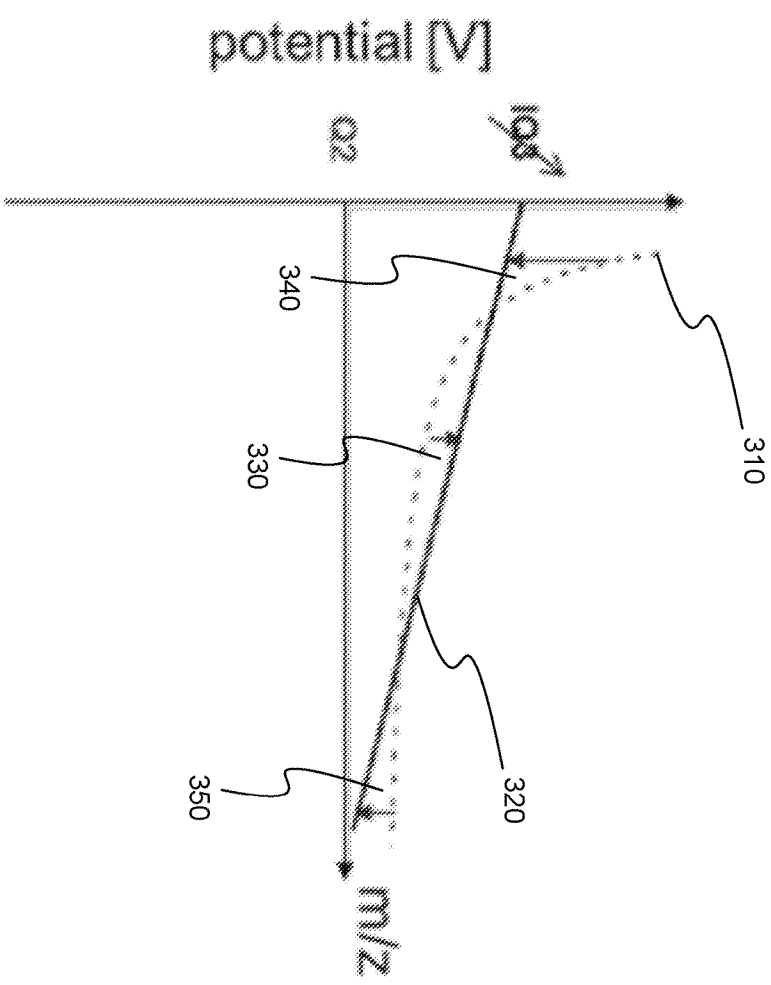
FIG. 3 is an exemplary plot of potential voltage versus mass-to-charge ratio (m/z) showing how positive ions are either extracted or trapped using the system of FIG. 2, in accordance with various embodiments.

FIG. 3 is an exemplary plot 300 of potential voltage versus mass-to-charge ratio (m/z) showing how positive ions are either extracted or trapped using system 200 of FIG. 2, in accordance with various embodiments. Axial trapping AC voltage of lens electrode 230 applied using circuitry 232 in FIG. 2 produces an axial mass dependent potential barrier shown as dotted line curve 310 in FIG. 3. The combination of the radial dipole DC voltage of multipole rod set 220 applied using circuitry 226 and the radial RF trapping voltage amplitude of multipole rod set 220 applied using circuitry 222 shown in FIG. 2 produces a mass dependent potential in multipole rod set 220, which is shown as solid line 320 in FIG. 3.

More simply, curve 310 of FIG. 3 shows the voltage positive ions experience from lens electrode 230 of FIG. 2, and line 320 of FIG. 3 shows the voltage amplitude positive ions experience from multipole rod set 220 of FIG. 2. Positive ions with a particular m/z range are extracted from lens electrode 230 when the potential of lens electrode 230 of FIG. 2 is lower than the potential of multipole rod set 220 of FIG. 2. As a result, positive ions that have an m/z of region 330 of FIG. 3 are extracted. Likewise, positive ions are trapped when the potential of lens electrode 230 of FIG. 2 is higher than the potential of multipole rod set 220 of FIG. 2. As a result, positive ions that have an m/z of region 340 or 350 remain trapped in multipole rod set 220 of FIG. 2. FIG. 3, therefore, shows that region 330 provides a bandpass range of m/z values. The bandpass range is varied by simultaneously changing curve 310 and line 320.

Data Example

In order to demonstrate bandpass extraction using system 200 of FIG. 2, an iterative procedure of bandpass extraction followed by m/z independent extract is performed. In step 1 of this procedure, CID fragments of a protonated peptide: $[ALILTLVS+2H]^{2+}$ sample are trapped by multipole rod set 220. In step 2, the band pass extraction for an m/z bandpass filter range is performed. Extracted ions are measured for the bandpass filter range using a mass analyzer and a mass spectrum for the filtered ions is obtained. In step 3, the remaining ions are extracted independent of any m/z range. These ions are also measured using the mass analyzer and a mass spectrum for the remaining ions is obtained. In step 4, the m/z bandpass filter range is shifted and steps 1-4 are repeated until an entire mass range of the sample is analyzed.

Figure 4:
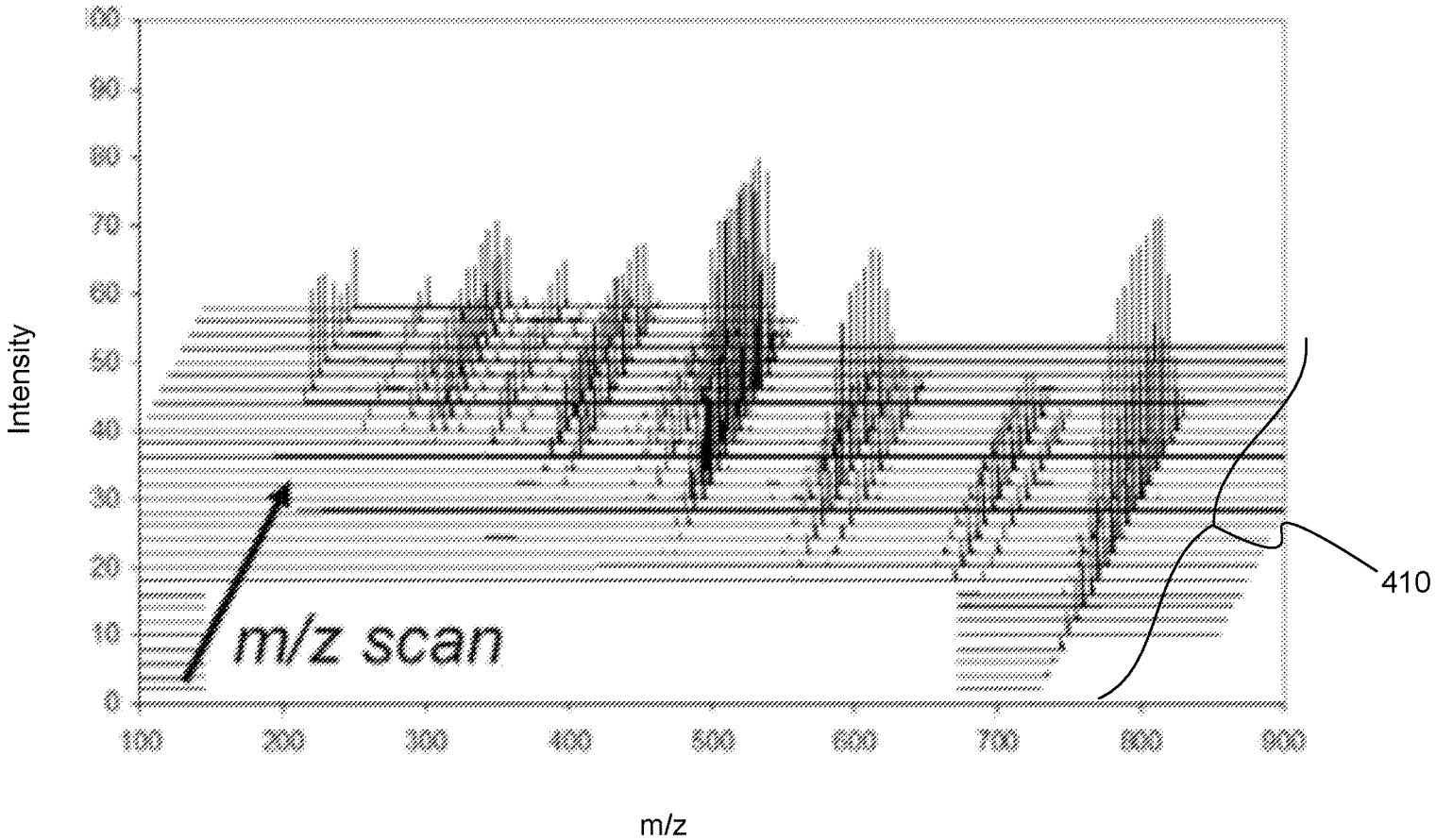
FIG. 4 is a three-dimensional plot of spectra produced for filtered ions that are extracted using the system of FIG. 2, in accordance with various embodiments.

FIG. 4 is a three-dimensional plot 400 of spectra 410 produced for filtered ions that are extracted using system 200 of FIG. 2, in accordance with various embodiments. Spectra 410 for filtered ions in FIG. 4 are plotted as the bandpass filter range is shifted. As spectra 410 are plotted into the page, they represent the spectra produced as the center of the bandpass filter range is shifted from a larger m/z value to a smaller m/z value.

Figure 5:
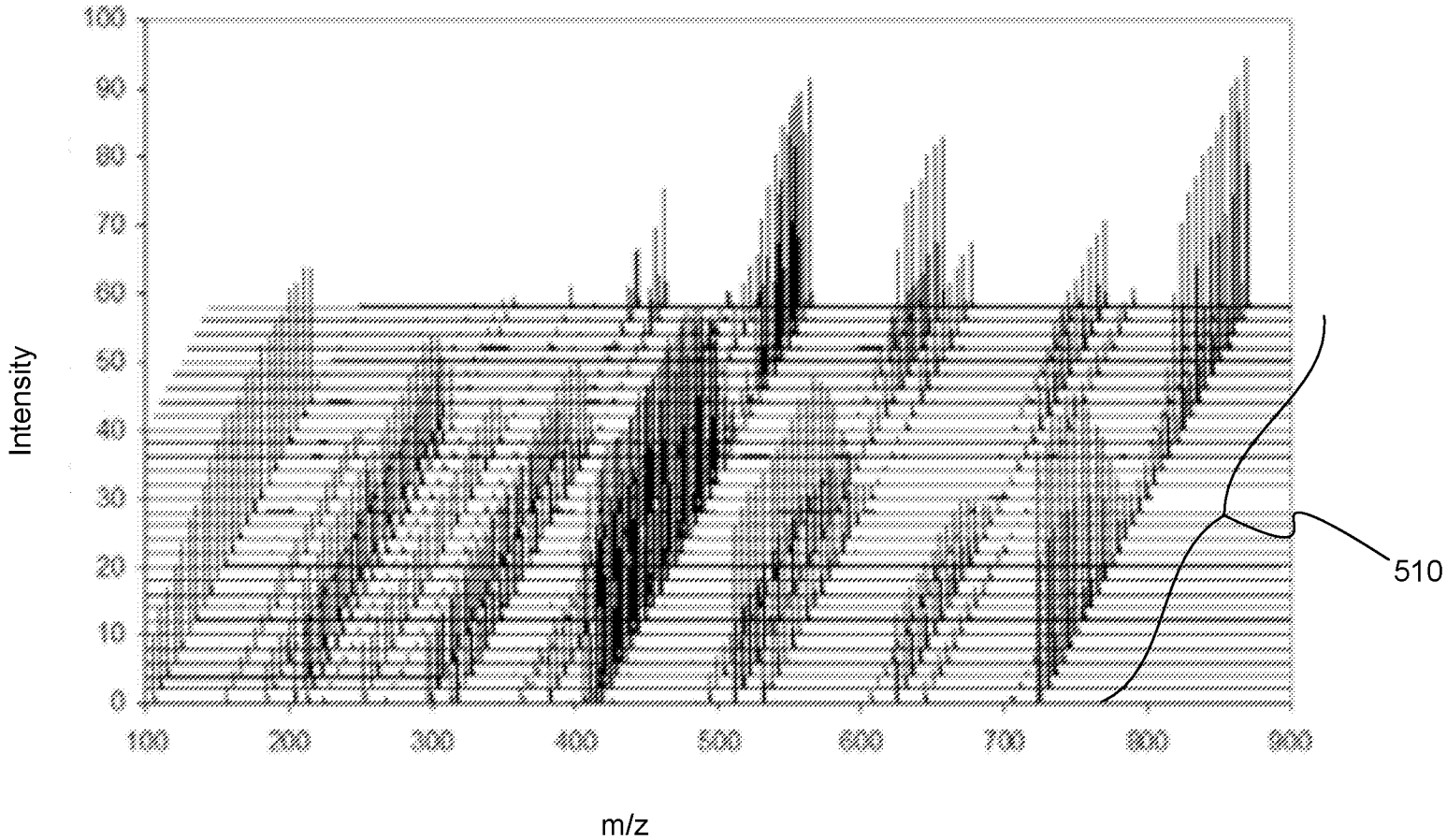
FIG. 5 is a three-dimensional plot of spectra produced for ions remaining after filtering using the system of FIG. 2, in accordance with various embodiments.

FIG. 5 is a three-dimensional plot 500 of spectra 410 produced for ions remaining after filtering using system 200 of FIG. 2, in accordance with various embodiments. Spectra 510 for remaining ions in FIG. 5 are plotted as the bandpass filter range is shifted. As spectra 510 are plotted into the page, they represent the spectra of remaining produced as the center of the bandpass filter range is shifted from a larger m/z value to a smaller m/z value.

A comparison of FIGS. 4 and 5 shows that spectra 410 of FIG. 4 are essentially notched out of spectra 510 of FIG. 5. This means that system 200 of FIG. 2 can continuously bandpass filter ions trapped by an ion guide. FIG. 5 also shows that there is no ion loss as a result of using system 200 of FIG. 2 to bandpass filter ions. FIG. 5 shows that all of the out-of band ions are recoverable.

System for Orthogonal TOF Sensitivity Enhancement

An orthogonal TOF mass analyzer receives ions in a direction of extraction. An accelerator of the TOF mass analyzer then fires or pulses the ions in a direction orthogonal to the direction of extraction. Since heavier ions move slower than lighter ion, heavy and light ions traveling in the direction of extraction can reach the accelerator of the TOF mass analyzer at different times. This reduces the sensitivity of the TOF analyzer. System 200 of FIG. 2 can enhance the sensitivity of a TOF analyzer by supplying the TOF analyzer with bands of ions that have more similar mass or m/z.

However, like different ions, different mass selected bands of ions can reach the accelerator of the TOF mass analyzer at different times. As a result, even the TOF mass analysis of continuously bandpass filtered ions may experience reduced sensitivity.

Figure 6:
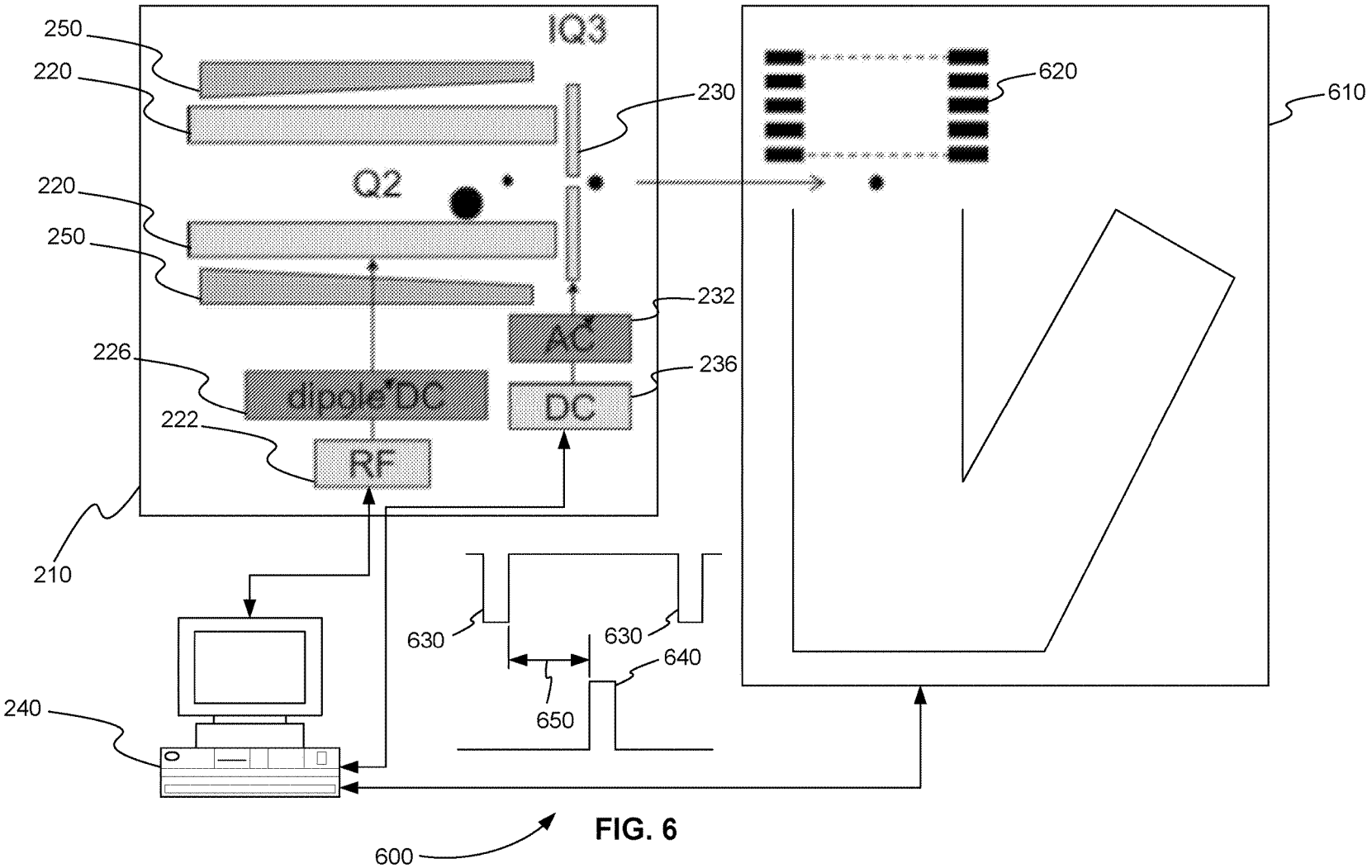
FIG. 6 is schematic diagram of a system for orthogonal time-of-flight (TOF) mass spectrometry sensitivity enhancement, in accordance with various embodiments.

FIG. 6 is schematic diagram of a system 600 for orthogonal TOF mass spectrometry sensitivity enhancement, in accordance with various embodiments. Like system 200 of FIG. 2, system 600 includes a multipole rod set 220 of ion guide 210, lens electrode 230 of ion guide 210, and processor 240. System 600 also optionally includes LINAC 250.

Processor 240 applies a radial dipole DC voltage to multipole rod set 220 using circuitry 226 and an axial trapping AC voltage to lens electrode 230 using circuitry 232 in order to extract a bandpass mass range of ions trapped in multipole rod set 220. Processor 240 holds the radial RF trapping voltage amplitude of multipole rod set 220 fixed using circuitry 222 and holds the DC voltage of lens electrode 230 fixed using circuitry 236.

Alternatively, processor 240 simultaneously applies a radial RF trapping voltage amplitude to multipole rod set 220 using circuitry 222 and an axial trapping AC voltage to the lens electrode using circuitry 232 in order to extract a bandpass mass range of ions trapped in multipole rod set 220. Processor 240 holds the radial dipole DC voltage of multipole rod set 220 fixed using circuitry 226 and holds the DC voltage of lens electrode 230 fixed using circuitry 236.

System 600, further includes TOF mass analyzer 610. TOF mass analyzer 610 is adapted to receive ions extracted from multipole rod set 220 through lens electrode 230. TOF mass analyzer 610 is also in communication with the processor 240.

Ions are continuously introduced into ion guide 210 from another ion guide (not shown), which can be, for example, a Q1 quadrupole. Ion guide 210 is a Q2 quadrupole, for example. Ions are continuously introduced into ion guide 210 for CID or ExD, for example. The precursor ions and dissociated ions are cooled by a gas while traveling in ion guide 210, for example, and then stored near lens electrode 230.

In various embodiments, processor 240 pulses the DC voltage of lens electrode 230 using circuitry 236 to extract a bandpass mass range of ions trapped in multipole rod set 220. Processor uses pulses 630, for example. After a delay, processor 240 then fires or pulses accelerator 620 of TOF mass analyzer 610 to accelerate the bandpass range of ions. Processor 240 pulses accelerator 620 using pulses 640, for example. The delay between a pulse 630 and a pulse 640 is delay 650, for example. Processor 240 calculates the delay based on the bandpass mass range. In other words, processor 240 enhances the sensitivity of TOF mass analyzer 610 by adjusting the delay between pulsing the DC voltage of lens electrode 230 and pulsing accelerator 620 based on the m/z of the band that was extracted. By properly calculating the delay, all the ions of the extracted band can be accelerated at the same time. Processor 240 adjusts the delay each time the extracted band is shifted or changed.

Method for Mass Selectively Extracting Ions

Figure 7:
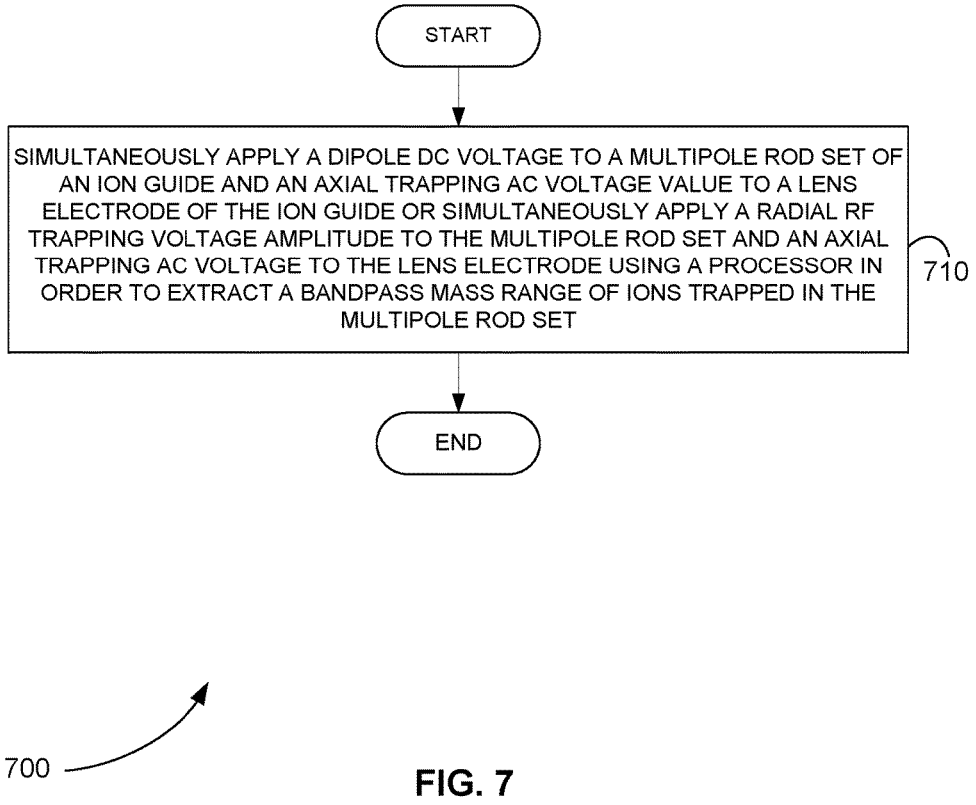
FIG. 7 is a flowchart showing a method for mass selectively extracting ions, in accordance with various embodiments.

FIG. 7 is a flowchart showing a method 700 for mass selectively extracting ions, in accordance with various embodiments.

In step 710 of method 700, a radial dipole DC voltage is applied to a multipole rod set of an ion guide and an axial trapping AC voltage is simultaneously applied to a lens electrode of the ion guide using a processor in order to extract a bandpass mass range of ions trapped in the multipole rod set. Alternatively, a radial RF trapping voltage amplitude is applied to the multipole rod set and an axial trapping AC voltage is simultaneously applied to the lens electrode using the processor in order to extract a bandpass mass range of ions trapped in the multipole rod set. The multipole rod set is adapted to receive the radial RF trapping voltage and the radial dipole direct current DC voltage. The lens electrode is positioned at one end of the multipole rod set to extract ions trapped by the multipole rod set and adapted to receive the axial trapping AC voltage and a DC voltage.

Computer Program Product for Mass Selectively Extracting Ions

In various embodiments, computer program products include a tangible computer-readable storage medium whose contents include a program with instructions being executed on a processor so as to perform a method for mass selectively extracting ions. This method is performed by a system that includes one or more distinct software modules.

Figure 8:
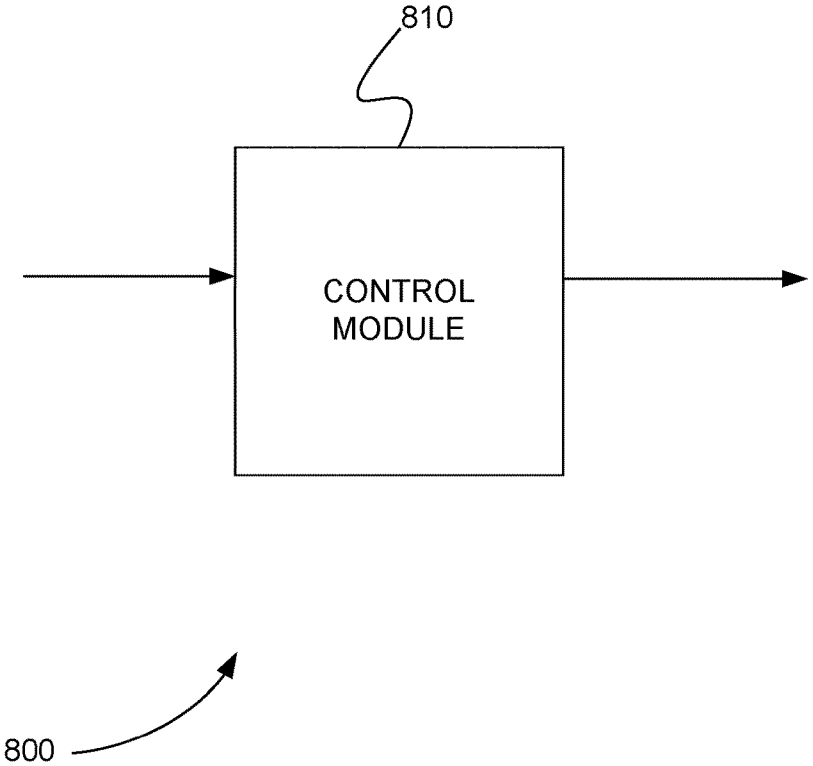
FIG. 8 is a schematic diagram of a system that includes one or more distinct software modules that performs a method for mass selectively extracting ions, in accordance with various embodiments.

FIG. 8 is a schematic diagram of a system 800 that includes one or more distinct software modules that performs a method for mass selectively extracting ions, in accordance with various embodiments. System 800 includes control module 810. Control module 810 simultaneously applies a radial dipole DC voltage to a multipole rod set of an ion guide and an axial trapping AC voltage to a lens electrode of the ion guide in order to extract a bandpass mass range of ions trapped in the multipole rod set. Alternatively, control module 810 simultaneously applies a radial RF trapping voltage amplitude to the multipole rod set and an axial trapping AC voltage to the lens electrode using the control module in order to extract a bandpass mass range of ions trapped in the multipole rod set. The multipole rod set is adapted to receive the radial RF trapping voltage and the radial dipole DC voltage. The lens electrode is positioned at one end of the multipole rod set to extract ions trapped by the multipole rod set and adapted to receive the axial trapping AC voltage and a DC voltage.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for mass selectively extracting ions, comprising:

a multipole rod set of an ion guide adapted to receive a radial radio frequency (RF) trapping voltage and a radial dipole direct current (DC) voltage;

a lens electrode of the ion guide positioned at one end of the multipole rod set to extract ions trapped by the multipole rod set and adapted to receive an axial trapping alternating current (AC) voltage and a DC voltage; and a processor in communication with the multipole rod set and the lens electrode that applies in combination the radial dipole DC voltage to the multipole rod set, the axial trapping AC voltage to the lens electrode, the radial RF trapping voltage amplitude to the multipole rod set and the DC voltage to the lens electrode in order to extract a bandpass mass range of ions trapped in the multipole rod set;

wherein the processor applies the DC voltage on the lens electrode that is less than the radial dipole DC voltage that the processor applies to the multipole rod set when the multipole rod set is used to trap positive ions; and wherein the processor applies the DC voltage on the lens electrode that is greater than the radial dipole DC voltage that the processor applies to the multipole rod set when the multipole rod set is used to trap negative ions.

2. The system of claim 1, further comprising a linear accelerator positioned coaxially with the multipole rod set to further accelerate ions trapped in the multipole rod set and to further accumulate ions near the lens electrode.

3. The system of claim 1, further comprising a time-of-flight (TOF) mass analyzer adapted to receive ions extracted from the multipole rod set through the lens electrode and in communication with the processor.

4. The system of claim 3, wherein the processor pulses the DC voltage of the lens electrode to extract the bandpass mass range of ions trapped in the multipole rod set and after a delay pulses an accelerator of the TOF mass analyzer to enhance the sensitively of TOF mass analysis.

5. The system of claim 4, wherein the processor calculates the delay based on the bandpass mass range.

6. A method for mass selectively extracting ions, comprising:

applying in combination a radial dipole direct current (DC) voltage to a multipole rod set of an ion guide, an axial trapping alternating current (AC) voltage to a lens electrode of the ion guide, a radial radio frequency (RF) trapping voltage amplitude to the multipole rod set and a DC voltage to the lens electrode using a processor in order to extract a bandpass mass range of ions trapped in the multipole rod set;

wherein the multipole rod set is adapted to receive the radial RF trapping voltage and the radial dipole voltage DC and wherein the lens electrode is positioned at one end of the multipole rod set to extract ions trapped by the multipole rod set and adapted to receive the axial trapping AC voltage and the DC voltage;

applying the DC voltage on the lens electrode that is less than the radial dipole DC voltage applied to the multipole rod set when the multipole rod set is used to trap positive ions using the processor; and applying the DC voltage on the lens electrode that is greater than the radial dipole DC voltage applied to the multipole rod set when the multipole rod set is used to trap negative ions using the processor.

7. The method of claim 6, wherein the ion guide further comprises a linear accelerator positioned coaxially with the multipole rod set to further accelerate ions trapped in the multipole rod set and to further accumulate ions near the lens electrode.

8. The method of claim 6, further comprising communicating with a time-of-flight (TOF) mass analyzer adapted to receive ions extracted from the multipole rod set through the lens electrode using the processor.

9. The method of claim 8, further comprising pulsing the DC voltage of the lens electrode to extract the bandpass mass range of ions trapped in the multipole rod set and after a delay pulsing an accelerator of the TOF mass analyzer using the processor to enhance the sensitively of TOF mass analysis.

10. The method of claim 9, further comprising calculating the delay based on the bandpass mass range using the processor.

11. A computer program product, comprising a non-transitory and tangible computer-readable storage medium whose contents include a program with instructions being executed on a processor so as to perform a method for mass selectively extracting ions, the method comprising:

providing a system, wherein the system comprises one or more distinct software modules, and wherein the distinct software modules comprise a control module; and applying in combination a radial dipole direct current (DC) voltage to a multipole rod set of an ion guide and an axial trapping alternating current (AC) voltage to a lens electrode of the ion guide, a radial radio frequency (RF) trapping voltage amplitude to the multipole rod set and a DC voltage to the lens electrode using the control module in order to extract a bandpass mass range of ions trapped in the multipole rod set;

wherein the multipole rod set is adapted to receive the radial RF trapping voltage and the radial dipole DC voltage and wherein the lens electrode is positioned at one end of the multipole rod set to extract ions trapped by the multipole rod set and adapted to receive the axial trapping AC voltage and the DC voltage;

wherein the processor applies the DC voltage on the lens electrode that is less than the radial dipole DC voltage that the processor applies to the multipole rod set when the multipole rod set is used to trap positive ions; and wherein the processor applies the DC voltage on the lens electrode that is greater than the radial dipole DC voltage that the processor applies to the multipole rod set when the multipole rod set is used to trap negative ions.

* * * * *